US009469046B2

(12) United States Patent
Cholewczynski et al.

(10) Patent No.: US 9,469,046 B2
(45) Date of Patent: Oct. 18, 2016

(54) BUTT FLARE REDUCING APPARATUS FOR LOGS AND RELATED METHODS OF REDUCING BUTT FLARE

(71) Applicant: Nicholson Intellectual Property, Inc., Seattle, WA (US)

(72) Inventors: Marek Cholewczynski, Victoria (CA); Jorgen Lefsrud, Victoria (CA)

(73) Assignee: Nicholson Intellectual Property, Inc., Seattle, WA (US)

( * ) Notice: Subject to any disclaimer, the term of this patent is extended or adjusted under 35 U.S.C. 154(b) by 109 days.

(21) Appl. No.: 14/807,725

(22) Filed: Jul. 23, 2015

(65) Prior Publication Data

US 2016/0031116 A1 Feb. 4, 2016

Related U.S. Application Data

(60) Provisional application No. 62/030,449, filed on Jul. 29, 2014.

(51) Int. Cl.

| | |
|---|---|
| ***B27L 1/10*** | (2006.01) |
| ***B27C 5/08*** | (2006.01) |
| ***B27C 7/00*** | (2006.01) |
| ***B27L 1/00*** | (2006.01) |
| ***B27L 1/08*** | (2006.01) |

(52) U.S. Cl.

CPC . *B27L 1/10* (2013.01); *B27C 5/08* (2013.01); *B27C 7/005* (2013.01); *B27L 1/00* (2013.01); *B27L 1/08* (2013.01)

(58) Field of Classification Search

CPC ..... B27L 1/04; B27L 1/045; B27L 1/05; B27L 1/08; B27L 1/10; B27L 1/12; B27L 1/127; A01G 23/095; A01G 23/0955; A01G 23/097; A01G 23/099; B27C 7/005; B27C 5/08

See application file for complete search history.

(56) References Cited

U.S. PATENT DOCUMENTS

| | | | | |
|---|---|---|---|---|
| 3,013,593 | A | 12/1961 | McDonald | |
| 4,653,561 | A * | 3/1987 | Payeur | B27L 1/05 144/208.8 |
| 6,991,011 | B2 | 1/2006 | Huhtasalo | |
| 2003/0226617 | A1 | 12/2003 | Choquette | |
| 2012/0305137 | A1 * | 12/2012 | Cholewczynski | B27L 1/08 144/208.8 |

FOREIGN PATENT DOCUMENTS

| | | |
|---|---|---|
| DE | 137437 C | 12/1902 |

OTHER PUBLICATIONS

European Patent Office; "International Search Report" and "Written Opinion of the International Searching Authority;" in international application No. PCT/US2015/041838; mailed Oct. 7, 2015; 11 pages total.

* cited by examiner

*Primary Examiner* — Matthew G Katcoff
(74) *Attorney, Agent, or Firm* — Seed IP Law Group PLLC

(57) ABSTRACT

A butt flare reducing apparatus for logs is provided. The apparatus includes a machine frame, a stator ring assembly fixedly coupled to the machine frame, and a flare reducing tool adjustment assembly movably coupled to the stator ring assembly. The apparatus further includes an actuator coupled on one end to the machine frame and on the other end to the flare reducing tool adjustment assembly to move the flare reducing tool adjustment assembly between the opposing end positions, and a rotor assembly rotatably coupled to the stator ring assembly. The rotor assembly includes a rotor frame and at least one flare reducing tool movably coupled to the rotor frame to translate linearly toward and away from a longitudinal axis of rotation in direct correlation to movement of the actuator and flare reducing tool adjustment assembly to adjust a log processing diameter. Related methods are also provided.

17 Claims, 8 Drawing Sheets

BUTT FLARE REDUCING APPARATUS FOR LOGS AND RELATED METHODS OF REDUCING BUTT FLARE

BACKGROUND

1. Technical Field

The present disclosure generally relates to butt flare reducing apparatuses for removing the protruding root flares from the butt end of logs and related methods.

2. Description of the Related Art

Butt flare reducing apparatuses are used to reshape the butt end of logs to remove the natural protruding root flares to provide a more consistent cross-sectional profile for further processing of the logs into lumber and other wood products. An example of a butt flare reducing apparatus is shown and described in US Patent Application Publication No. 2003/0226617 to Choquette, which is incorporated herein by reference in its entirety.

BRIEF SUMMARY

Embodiments of the butt flare reducing apparatuses and related methods described herein are particularly well suited to provide efficient, robust and reliable adjustment of log processing diameters before and/or during butt flare reducing operations.

According to some embodiments, a butt flare reducing apparatus for logs may be summarized as including a machine frame; a stator ring assembly fixedly coupled to the machine frame; a flare reducing tool adjustment assembly movably coupled to the stator ring assembly to move longitudinally between opposing end positions; an actuator coupled to the flare reducing tool adjustment assembly to move the flare reducing tool adjustment assembly longitudinally between the opposing end positions; and a rotor assembly rotatably coupled to the stator ring assembly to rotate about a longitudinal axis of rotation. The rotor assembly includes a rotor frame and a at least one flare reducing tool movably coupled to the rotor frame to translate linearly toward and away from the longitudinal axis of rotation in direct correlation to movement of the actuator and flare reducing tool adjustment assembly to adjust a log processing diameter.

The flare reducing tool may be one of a plurality of flare reducing tools arranged in a circular array and the plurality of flare reducing tools may define a maximum log diameter when the flare reducing tool adjustment assembly is in one of the opposing end positions and may define a minimum log diameter when the flare reducing tool adjustment assembly is in the other one of the opposing end positions.

The rotor assembly may include, for each flare reducing tool, a respective series of mechanical power transmission components coupled to the flare reducing tool to translate longitudinal motion of the flare reducing tool adjustment assembly to radially orientated translational motion of the flare reducing tool. Each of the series of mechanical power transmission components may include, for example, racks and gears. In some instances, each of the series of mechanical power transmission components may include an input rack that is coupled to an output rack by at least one intermediate gear. The input rack may be arranged longitudinally and the output rack may be arranged perpendicularly thereto. At least two intermediate gears may be positioned between the input rack and the output rack with one of the intermediate gears in meshing engagement with the input rack and another one of the intermediate gears in meshing engagement with the output rack. In such instances, a ratio of travel of the output rack relative to travel of the input rack may be dependent on characteristics of the intermediate gears, such as gear diameter.

The rotor assembly may further include at least force resisting member (e.g., a coil or helical spring, pneumatic bladder, damper, dashpot, hydraulic cylinder with accumulator) coupled between the flare reducing tool and the rotor frame to counterbalance centrifugal force applied to the flare reducing tool as the rotor assembly rotates during operation.

The apparatus may further comprise a control system. In some instances, the control system may be configured to successively measure each of a series of logs upstream of the rotor assembly, determine, for each successive log, a desired radial position of the flare reducing tools based on a usable diameter of the log derived from said measurements, and adjust, for each successive log, a respective position of each of the flare reducing tools simultaneously to correspond to the desired radial position.

According to some embodiments, a method of reducing the butt flare on each of a series of logs may be summarized as including: successively measuring each of the series of logs upstream of an array of flare reducing tools that are each mounted to a rotatable rotor frame to translate linearly along a respective tool path toward and away from a longitudinal axis of rotation about which the rotor frame rotates; determining, for each successive log, a desired radial position of the flare reducing tools based on a usable diameter of the log derived from said measurements; and adjusting, for each successive log, a position of each flare reducing tool along the respective tool path thereof to correspond to the desired radial position for reducing a butt flare of the log.

In some instances, adjusting the position of each flare reducing tool along the respective tool path may include actuating an array of cylinders to displace all of the flare reducing tools toward or away from the longitudinal axis of rotation simultaneously. Actuating the array of cylinders to displace the flare reducing tools may include converting longitudinal motion of the cylinders to linear motion of the flare reducing tools perpendicular to the longitudinal axis of rotation. Converting longitudinal motion of the cylinders to linear motion of the flare reducing tools may include converting longitudinal motion of the cylinders to linear motion of the flare reducing tools via a series of mechanical power transmission components (e.g., racks and gears). For example, in some instances, converting longitudinal motion of the cylinders to linear motion of the flare reducing tools may include, for each flare reducing tool, moving a respective input rack longitudinally to rotate at least one respective gear to displace a respective output rack in a direction perpendicular to the input rack. Translating longitudinal motion of the cylinders to linear motion of the flare reducing tools may include longitudinally displacing a flare reducing tool adjustment assembly that is slidably coupled to a stator ring assembly about which the rotor frame rotates. The method may further include obtaining positional data from at least one cylinder of the array of cylinders and using said positional data to precisely control the position of the flare reducing tools.

DETAILED DESCRIPTION

Figure 1:
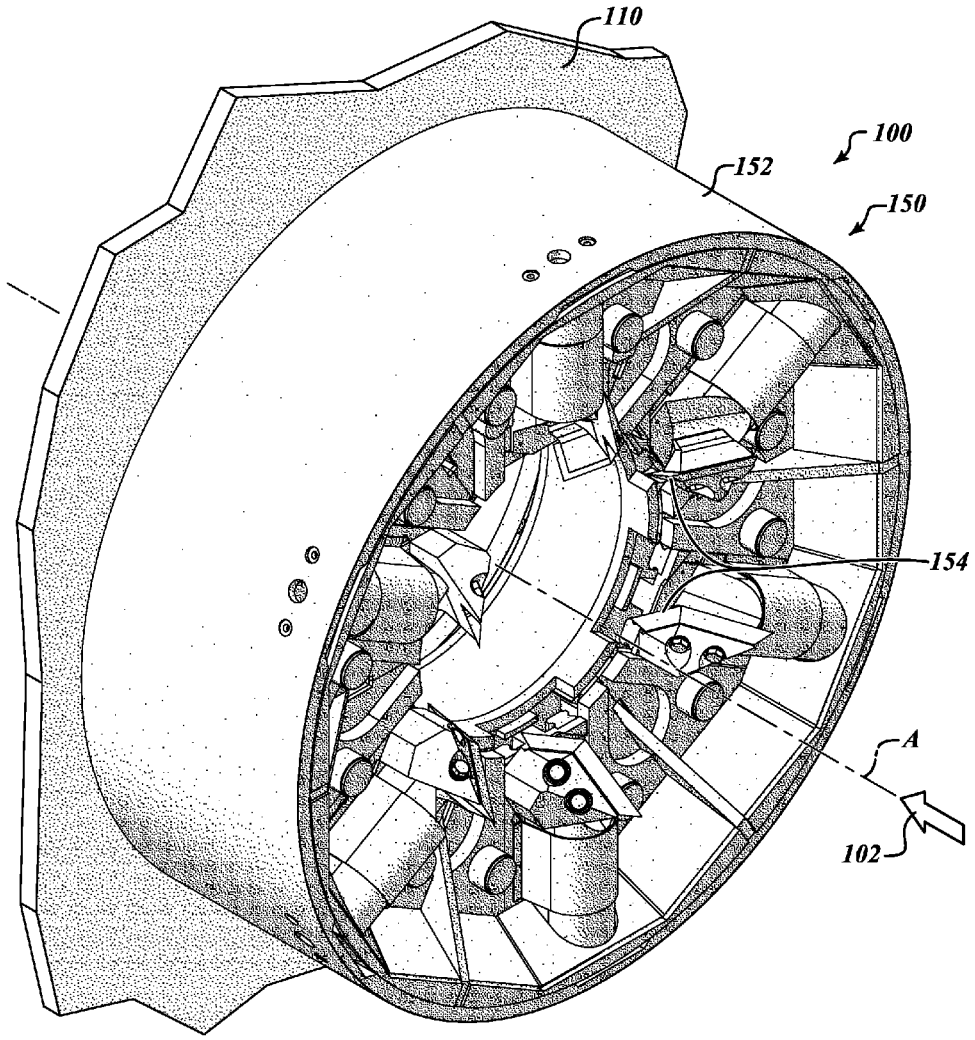
FIG. 1 is an isometric view of a butt flare reducing apparatus, according to one example embodiment, which includes a plurality of flare reducing tools shown in a retracted or maximum log diameter configuration.
Figure 2:
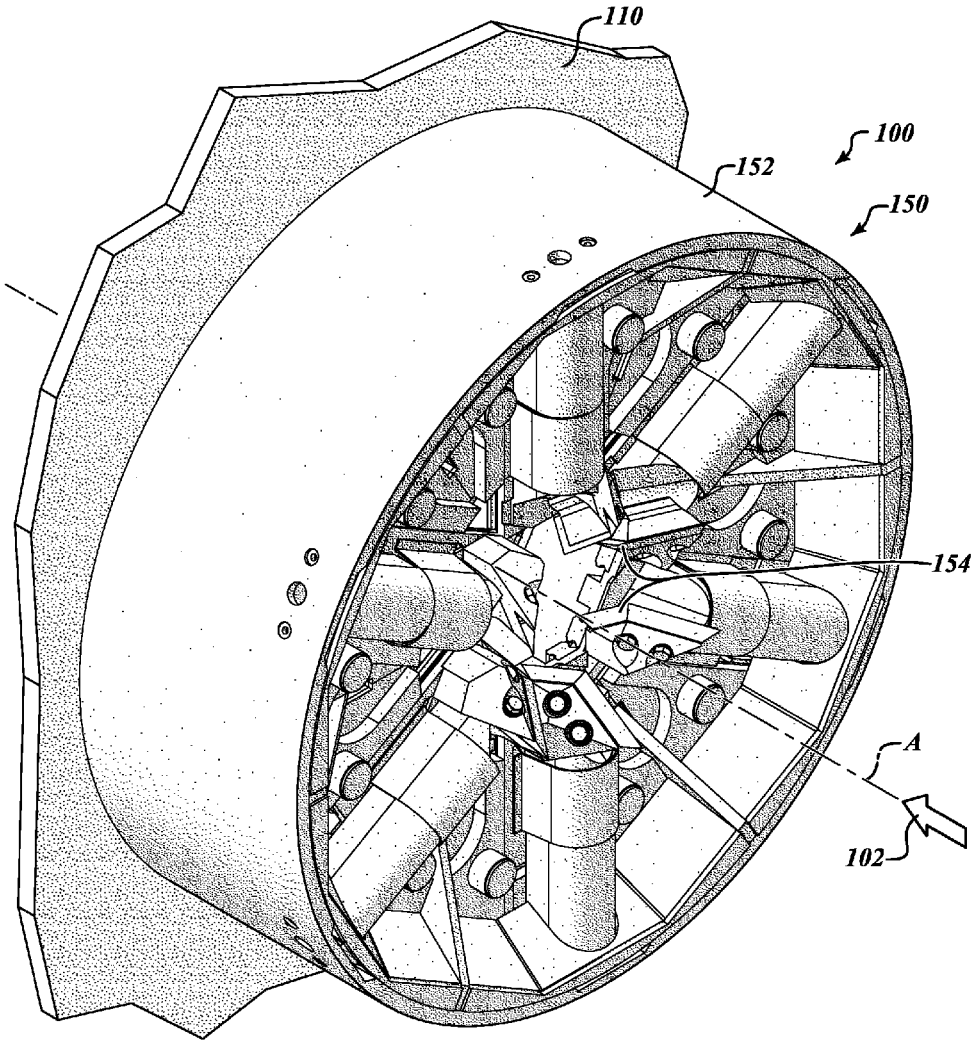
FIG. 2 is an isometric view of the butt flare reducing apparatus of FIG. 1 with the plurality of flare reducing tools shown in an extended or minimum log diameter configuration.

In the following description, certain specific details are set forth in order to provide a thorough understanding of various disclosed embodiments. However, one skilled in the relevant art will recognize that embodiments may be practiced without one or more of these specific details. In other instances, well-known structures and techniques associated with butt flare reducing apparatuses may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

FIGS. 1 through 7 show one example embodiment of a butt flare reducing apparatus 100 for processing the butt end of logs. The butt flare reducing apparatus 100 may receive logs lengthwise along a transport path in a direction indicated by the arrow labeled 102 and may remove the natural protruding root flares at the butt end of the logs with a plurality of rotating flare reducing tools 154 as the logs are transported through the apparatus 100. Well-known structures and techniques associated with log feed systems 186 (FIGS. 3 and 4) for moving and positioning logs for processing operations are not shown or described in detail to avoid unnecessarily obscuring descriptions of the embodiments. Advantageously, a log processing diameter defined by the radial position of the rotating flare reducing tools 154 may be efficiently and reliably adjusted by moving each flare reducing tool 154 linearly along a respective tool path P toward or away from a longitudinal axis of rotation A of the apparatus 100 before and/or during butt flare reducing operations as described in more detail elsewhere, and as indicated by the double headed arrow labeled 156 in FIG. 3, for example.

The butt flare reducing apparatus 100 may be combined with or positioned near, or incorporated into, other log processing equipment, such as, for example, the debarker systems shown and described in U.S. Patent Application Publication No. US2012/0305137 to Cholewczynski, which is incorporated herein by reference in its entirety. In some instances, for example, the butt flare reducing apparatus 100 may be positioned downstream of a debarker system to receive logs in a debarked condition. In other instances, the butt flare reducing apparatus 100 may be positioned upstream of a debarker system to discharge flareless logs for subsequent debarking operations. In still other instances, the butt flare reducing apparatus 100 may be combined with features and components of a debarker system to provide an integrated machine that can remove bark and remove root flares from the butt end of the logs.

With continued reference to FIGS. 1 through 7, the butt flare reducing apparatus 100 may include a machine frame 110 that is fixedly secured to a foundation (not shown), such as, for example, the foundation of a mill for processing logs into lumber and/or other wood products. In operation, the machine frame 110 remains static while various adjoining components rotate, translate and/or otherwise move relative thereto.

The butt flare reducing apparatus 100 may further include a stator ring assembly 120 that is fixedly coupled (e.g., via bolts, welds or other joining techniques) to the machine frame 110 to remain static therewith during operation while other adjoining components rotate, translate and/or otherwise move relative thereto. The stator ring assembly 120 may include a generally annular structure with a circumferential array of linear guide rails 134, as shown best in FIG. 7.

Figure 3:
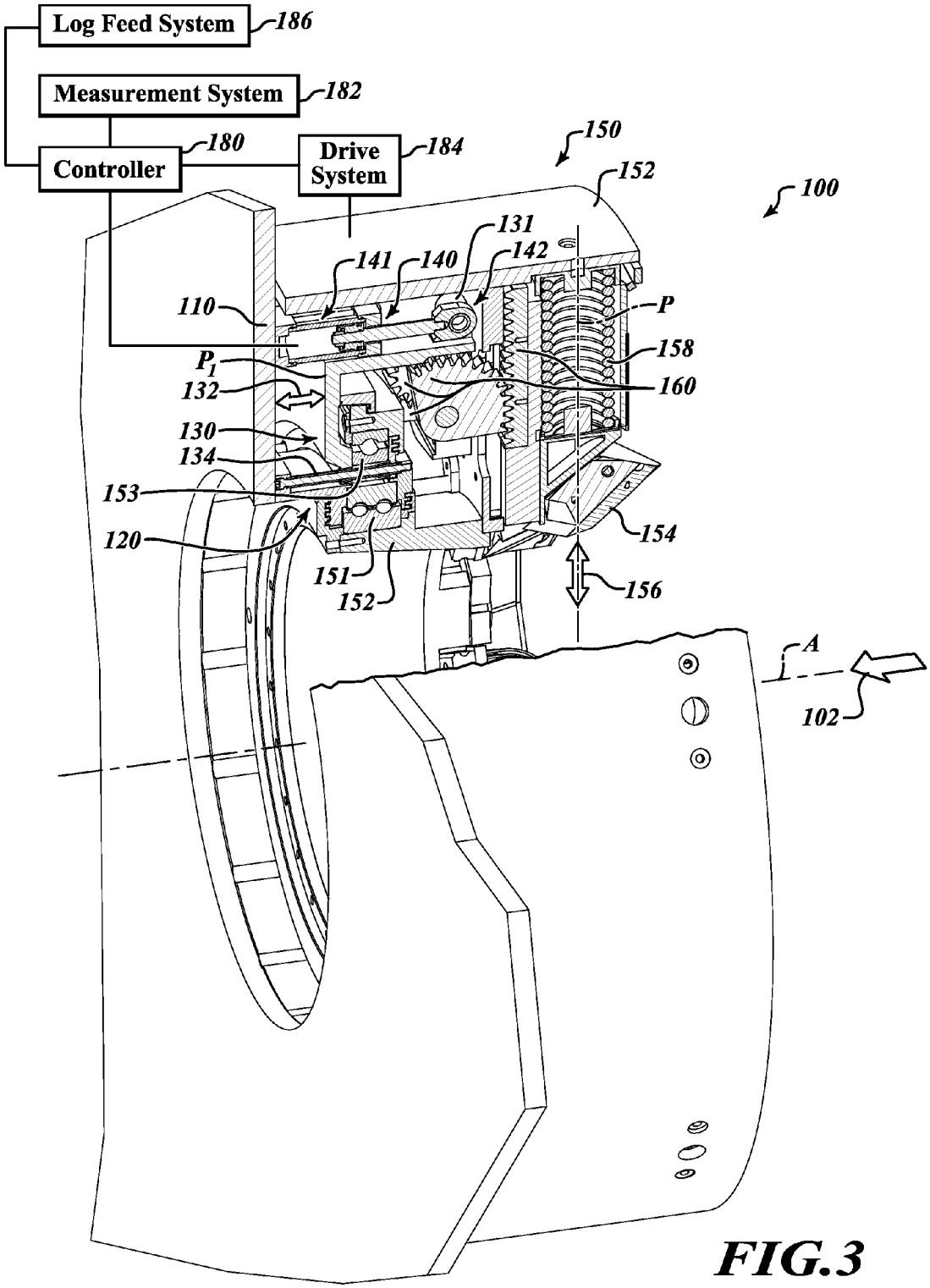
FIG. 3 is a skewed isometric view of the butt flare reducing apparatus of FIG. 1 with a portion removed to reveal internal components of the butt flare reducing apparatus in the retracted or maximum log diameter configuration.
Figure 4:
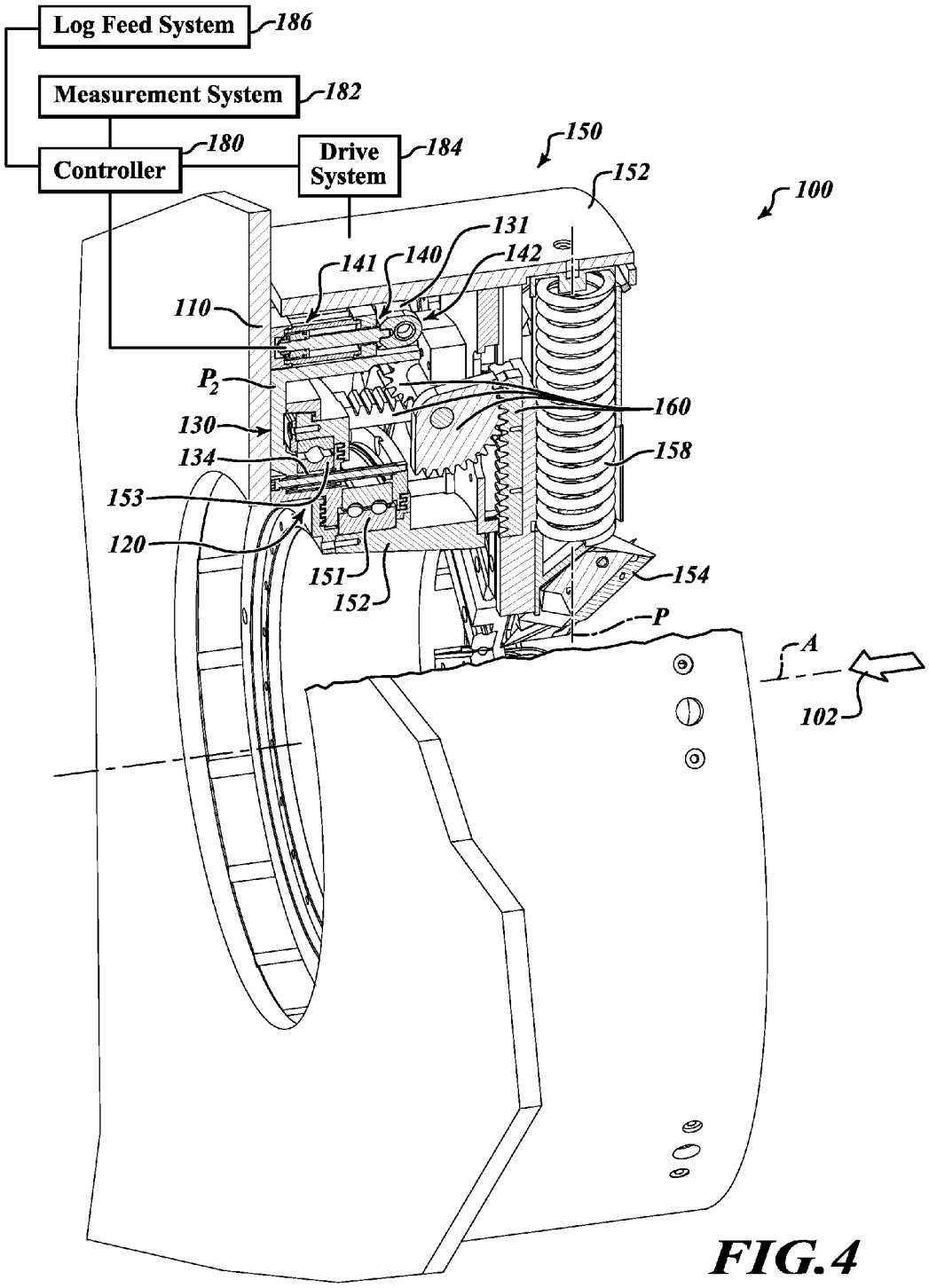
FIG. 4 is a skewed isometric view of the butt flare reducing apparatus of FIG. 1 with a portion removed to reveal internal components of the butt flare reducing apparatus in the extended or minimum log diameter configuration.
Figure 5:
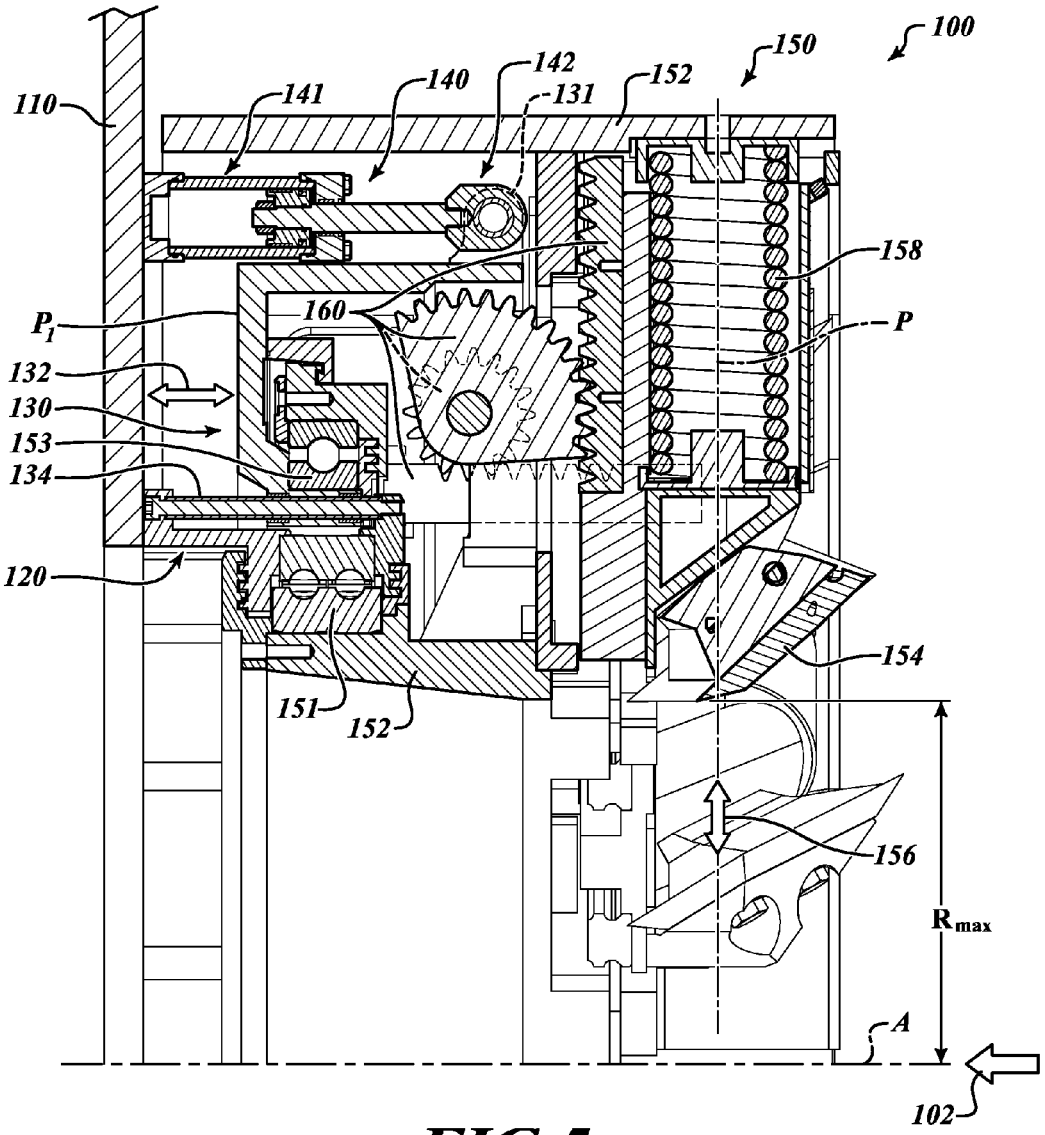
FIG. 5 is a partial cross-sectional side elevational view of the butt flare reducing apparatus of FIG. 1 showing internal components of the butt flare reducing apparatus in the retracted or maximum log diameter configuration.
Figure 6:
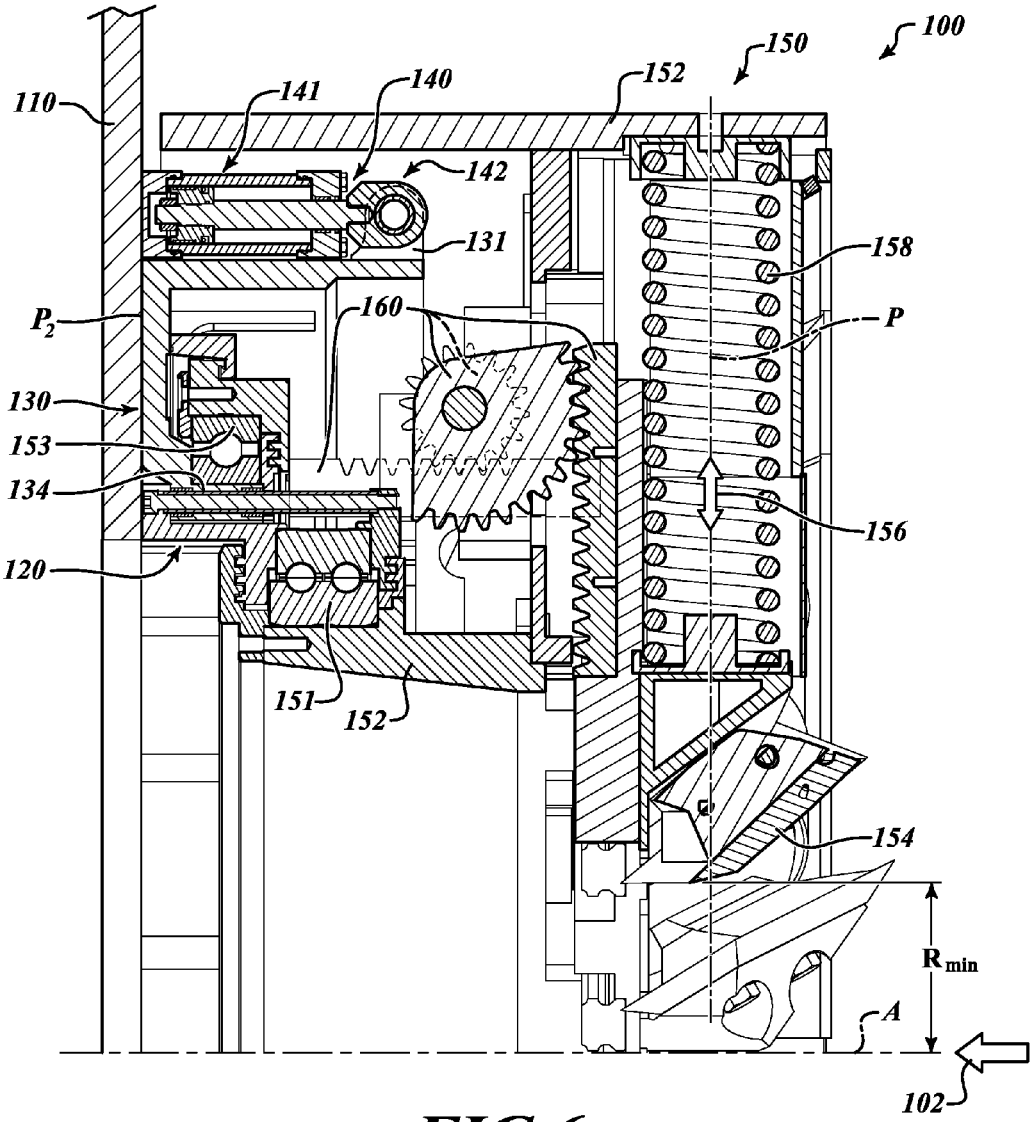
FIG. 6 is a partial cross-sectional side elevational view of the butt flare reducing apparatus of FIG. 1 showing internal components of the butt flare reducing apparatus in the extended or minimum log diameter configuration.
Figure 7:
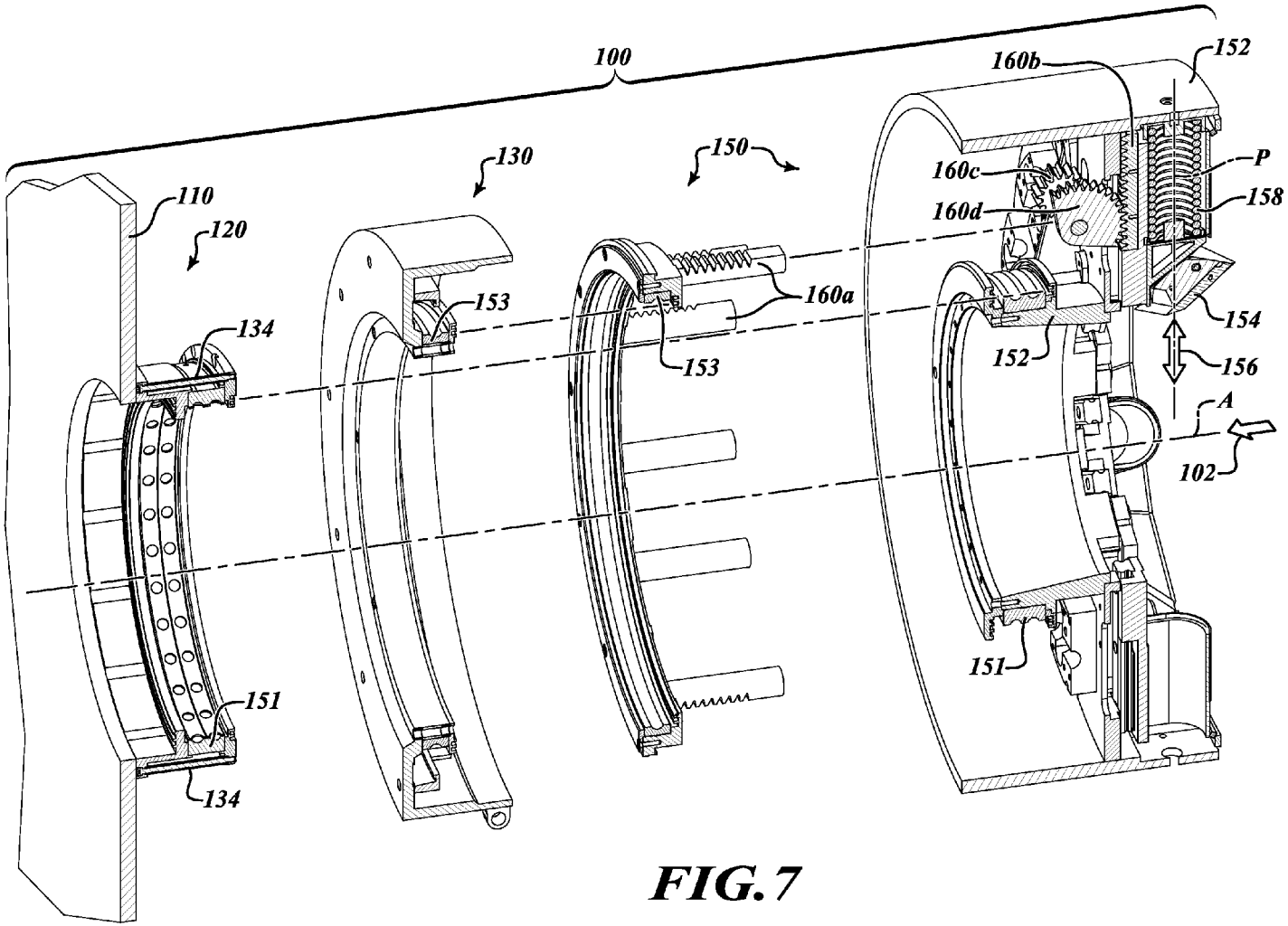
FIG. 7 is a skewed exploded cross-sectional view of the butt flare reducing apparatus of FIG. 1 with a single flare reducing tool shown in the retracted or maximum log diameter configuration. Other instances of the flare reducing tools and adjacent components have been removed for clarity.

The butt flare reducing apparatus 100 may further include a flare reducing tool adjustment assembly 130 that is movably coupled to the stator ring assembly 120 to move longitudinally between opposing end positions $P_1$, $P_2$, as indicated by the double headed arrow 132 shown in FIG. 3. More particularly the flare reducing tool adjustment assembly 130 may be movably coupled to the stator ring assembly 120 to move longitudinally along the circumferential array of linear guide rails 134 between a first end position $P_1$ as shown in FIGS. 3 and 5 and a second end position $P_2$ as shown in FIGS. 4 and 6.

The butt flare reducing apparatus 100 may further include one or more actuators 140 that are coupled on one end 141

(e.g., base end) to the stationary machine frame 110 and on the other end 142 (e.g., rod end) to the flare reducing tool adjustment assembly 130 to move the flare reducing tool adjustment assembly 130 longitudinally between the opposing end positions $P_1$, $P_2$. The one or more actuators 140 may be, for example, linear actuators in the form of hydraulic or pneumatic cylinders. In some instances, each of the one or more actuators 140 may be fixedly coupled on the one end 141 (e.g., base end) to the stationary machine frame 110 via welds, fasteners or other joining techniques, and may be coupled on the other end 142 (e.g., rod end) to the flare reducing tool adjustment assembly 130 via a pinned connection using lugs 131 of the flare reducing tool adjustment assembly 130, as shown, for example, in FIGS. 5 and 6.

The butt flare reducing apparatus 100 may further include a rotor assembly 150 that is rotatably coupled to the stator ring assembly 120 via a first rotational bearing 151 (e.g., a roller bearing with opposing races and roller elements therebetween) and rotatably coupled to the flare reducing tool adjustment assembly 130 via a second rotational bearing 153 (e.g., a roller bearing with opposing races and roller elements therebetween) to rotate about the longitudinal axis of rotation A during butt flare processing operations. The rotor assembly 150 may include a rotor frame 152 and the aforementioned plurality of flare reducing tools 154 that rotate in unison with the rotor frame 152. As described above, each flare reducing tool 154 may be movably coupled to the rotor frame 152 (e.g., via a sliding carriage arrangement) to translate linearly along a respective tool path P toward and away from the longitudinal axis of rotation A, as indicated by the double headed arrow labeled 156 in FIG. 3. In some instances, the flare reducing tools 154 move linearly toward and away from the longitudinal axis of rotation A in direct correlation to movement of the one or more actuators 140 and the flare reducing tool adjustment assembly 130 coupled thereto. In this manner, a log processing diameter defined by the radial position of the flare reducing tools 154 may be dynamically adjusted with precision before and/or during flare reducing operations by precisely controlling the one or more actuators 140.

With reference to FIG. 5, the plurality of flare reducing tools 154 define a maximum log diameter and maximum radial position $R_{max}$ when the flare reducing tool adjustment assembly 130 is in one of the opposing end positions $P_1$ (i.e., the rightmost position along rails 134 shown in FIG. 5). With reference to FIG. 6, the plurality of flare reducing tools 154 define a minimum log diameter and minimum radial position $R_{min}$ when the flare reducing tool adjustment assembly 130 is in the other one of the opposing end positions $P_2$ (i.e., the leftmost position along rails 134 shown in FIG. 6). In some embodiments, the linear stroke of each flare reducing tool 154 (i.e., $R_{max}$–$R_{min}$) may be about six inches or more to provide a wide range of available log processing diameters.

With reference to FIGS. 3 through 7, the rotor assembly 150 may include, for each flare reducing tool 154, a respective series of mechanical power transmission components 160, 160*a-d* that are coupled to the flare reducing tool 154 to translate longitudinal motion of the flare reducing tool adjustment assembly 130 to radially orientated translational motion of each flare reducing tool 154. As shown best in FIG. 7, the mechanical power transmission components 160 may include, for example, racks 160*a*, 160*b* and gears 160*c*, 160*d*. More particularly, the mechanical power transmission components 160 may include an input rack 160*a* coupled to an output rack 160*b* by intermediate gears 160*c*, 160*d*. The input rack 106*a* may be arranged longitudinally and the output rack 160*b* may be arranged perpendicularly to the input rack 160*a*. The mechanical power transmission components 160 may include, for each flare reducing tool 154, two or more intermediate gears 160*c*, 160*d* positioned between the input rack 160*a* and the output rack 160*b* with one of the intermediate gears 160*c* being in meshing engagement with the input rack 160*a* and another one of the intermediate gears 160*d* being in meshing engagement with the output rack 160*b*. According to the example embodiment shown in FIG. 7, one end of each input rack 160*a* may be captured or otherwise retained within a respective cavity of the rotor frame 152 such that the input racks 160*a* rotate in unison with the remainder of the rotor assembly 150. The other end of each input rack 160*a* may be fixed to an outer race of the rotational bearing 153 such that the outer race rotates with and forms a portion of the rotor assembly 150.

According to some embodiments, a ratio of travel of the output rack 160*b* relative to travel of the input rack 160*a* may be dependent on characteristics of the intermediate gears 160*c*, 160*d*. For example, the intermediate gears may have a gear ratio, such as, for example, 2:1, that results in the output rack 160*b* having twice the travel as the input rack 160*a*. In this manner, relatively small displacements of the input rack 160*a* (as driven by the one or more actuators 140) may result in significantly greater travel of the output rack 160*b* and hence the associated flare reducing tool 154.

The rotor assembly 150 may further include at least one force resisting member 158 (e.g., a coil or helical spring, pneumatic bladder, damper, dashpot, hydraulic cylinder with accumulator) coupled between each flare reducing tool 154 and the rotor frame 152 to counterbalance centrifugal forces that may be applied to the flare reducing tools 154 as the rotor assembly 130 rotates during operation. The force resisting member 158 may be selected and sized to effectively eliminate unwanted displacement of the flare reducing tools arising from such centrifugal forces.

With reference back to FIGS. 3 and 4, the butt flare reducing apparatus 100 may further include a control system, including a controller 180 (e.g., a configured computing system including a processor, memory, etc.), that is configured to control at least the rotational functionality of the rotor assembly 150 and movement of the one or more actuators 140 for adjusting the radial position of the flare reducing tools 154. For this purpose, the controller 180 may be communicatively coupled to a drive system 184 that is configured to drive the rotor assembly 150 about the longitudinal axis of rotation A. Well-known structures and techniques associated with the drive system 184, however, are not shown or described in detail to avoid unnecessarily obscuring descriptions of the embodiments.

The controller 180 may also be communicatively coupled to the one or more actuators 140 to adjust the longitudinal position of the flare reducing tool adjustment assembly 130, which is slidably coupled to the stator ring assembly 120. Displacement of the flare reducing tool adjustment assembly 130 in turn drives the power transmission components 160 and ultimately the flare reducing tools 154. To assist in accurately positioning the flare reducing tools 154, one or more sensors (not shown) may be provided to sense a position of one or more of the actuators 140 (or other movable components coupled thereto) and provide positional feedback to the controller 180 to provide further positional refinement of the one or more actuators 140, if needed. Again, the one or more actuators 140 may be linear actuators, such as hydraulic or pneumatic cylinders. The one or more sensors (not shown) may be high precision non-contact position sensors, such as those sold under the Tempsonics® brand, or other sensors having similar functionality.

With continued reference to FIGS. 3 and 4, the butt flare reducing apparatus 100 may further include a measurement system 182 (e.g., a light curtain) that is communicatively coupled to the controller 180. The measurement system 182 may be configured to successively measure each of a series of logs upstream of the rotor assembly 150 and determine, for each successive log, a desired radial position of the flare reducing tools 154 based on a usable diameter of the log derived from the measurements. The controller 180 may then control the one or more actuators 140 to adjust, for each successive log, an actual radial position of the flare reducing tools 154 simultaneously to correspond to the desired radial position for that log. In this manner, a log processing diameter can be adjusted dynamically for each log before and/or during operation without system shutdown and each log can be processed to remove butt flare with minimal to no wasting of usable log diameter.

In some embodiments, the flare reducing tools 154 may be moved to a fully retracted position (or maximum log diameter) at times between successive logs for safety purposes or to avoid potentially hazardous conditions that may occur upon power loss, for example. Depending on the size of the cut to be made and chipping power requirements related thereto, the controller 180 may communicate with a log feed system 186 to adjust the rate of incoming logs and/or may communicate with the drive system 184 to adjust the rotational speed of the rotor assembly 150.

In accordance with the embodiments of the butt flare reducing apparatuses 100 described herein, related methods of reducing butt flare on each of a series of logs are also provided. For instance, in some embodiments, a method of reducing butt flare on each of a series of logs may be provided which includes successively measuring each of the series of logs upstream of an array of flare reducing tools 154, which are each mounted to a rotatable rotor frame 152 to translate linearly along a respective tool path P toward and away from a longitudinal axis of rotation A about which the rotor frame 154 rotates. The method may further include determining, for each successive log, a desired radial position of the flare reducing tools 154 based on a usable diameter of the log derived from the measurements. Thereafter, the method may include adjusting, for each successive log, a radial position of each flare reducing tool 154 along the respective tool path P thereof to correspond to the desired radial position for reducing a butt flare of the log. In this manner, a log processing diameter can be adjusted dynamically for each log before and/or during operation without system shutdown and each log can be processed to remove butt flare with minimal to no wasting of usable log diameter.

In some instances, adjusting the position of each flare reducing tool 154 along the respective tool path P may include actuating an array of actuators 140 (e.g., hydraulic or pneumatic cylinders) to displace all of the flare reducing tools 154 toward or away from the longitudinal axis of rotation A simultaneously. Actuating the array of actuators 140 may include converting longitudinal motion of the actuators 140 to linear motion of the flare reducing tools 154 in a radial direction perpendicular to the longitudinal axis of rotation A. Converting longitudinal motion of the actuators 140 to linear motion of the flare reducing tools 154 may also include using a series of mechanical power transmission components 160. More particularly, the method may include moving a respective input rack 160*a* longitudinally to rotate at least one respective gear 160*c*, 160*d* to displace a respective output rack 160*b* in a direction perpendicular to the input rack 160*a*. In some instances, converting longitudinal motion of the actuators 140 to linear motion of the flare reducing tools 154 may include longitudinally displacing a flare reducing tool adjustment assembly 130 that is slidably coupled to a stator ring assembly 120 about which the rotor frame 152 rotates.

According to some embodiments, the method may further include obtaining positional data from at least one actuator 140 of the array of actuators 140 and using the positional data to precisely control the position of the flare reducing tools 154. For this purpose one or more sensors (not shown) may be provided to sense a position of the actuator 140 (or other movable components coupled thereto) and provide positional feedback to the controller 180 to provide further positional refinements of the one or more actuators 140, if needed. Again, the one or more sensors may be, for example, high precision non-contact position sensors, such as those sold under the Tempsonics® brand. In other instances, positional data for feedback control may be obtained directly from the flare reducing tool adjustment assembly 130 itself rather than from the one or more actuators 140. Positional data may be obtained from the flare reducing tool adjustment assembly 130, for example, using laser measuring devices or other position sensing devices.

Figure 8:
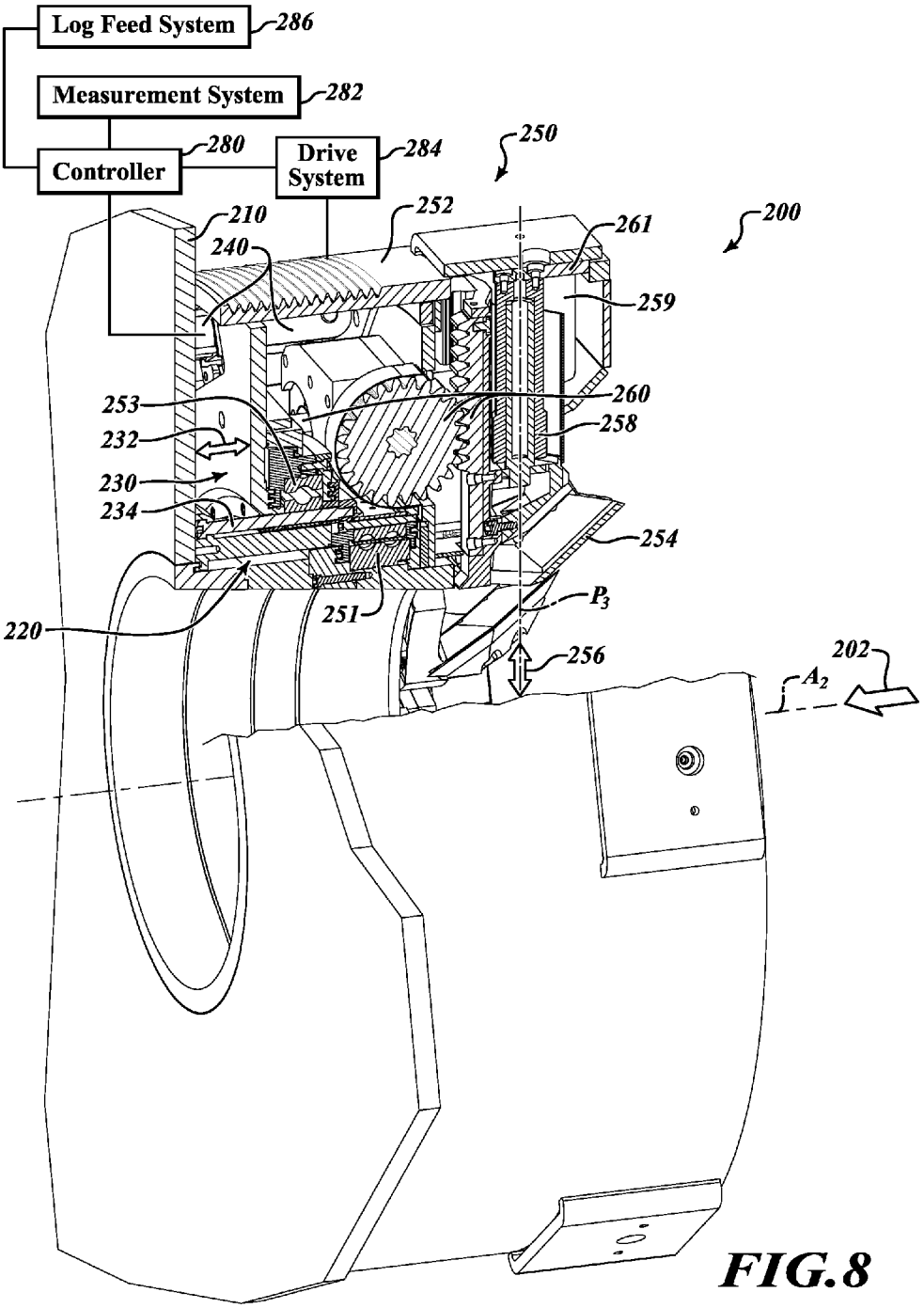
FIG. 8 is a partial cross-sectional side elevational view of a butt flare reducing apparatus, according to another embodiment, showing internal components of the butt flare reducing apparatus in a retracted or maximum log diameter configuration.

FIG. 8 shows another example embodiment of a butt flare reducing apparatus 200 for processing the butt end of logs. Similar to the aforementioned apparatus 100 shown in FIGS. 1 through 7, the butt flare reducing apparatus 200 may receive logs lengthwise along a transport path in a direction indicated by the arrow labeled 202 and may remove the natural protruding root flares at the butt end of the logs with a plurality of rotating flare reducing tools 254 as the logs are transported through the apparatus 200. Well-known structures and techniques associated with log feed systems 286 for moving and positioning logs for processing operations are not shown or described in detail to avoid unnecessarily obscuring descriptions of the embodiments. Advantageously, a log processing diameter defined by the radial position of the rotating flare reducing tools 254 may be efficiently and reliably adjusted by moving each flare reducing tool 254 linearly along a respective tool path $P_3$ toward or away from a longitudinal axis of rotation $A_2$ of the apparatus 200 before and/or during butt flare reducing operations, as indicated by the double headed arrow labeled 256.

With continued reference to FIG. 8, the butt flare reducing apparatus 200 may include a machine frame 210 that is fixedly secured to a foundation (not shown), such as, for example, the foundation of a mill for processing logs into lumber and/or other wood products. In operation, the machine frame 210 remains static while various adjoining components rotate, translate and/or otherwise move relative thereto.

The butt flare reducing apparatus 200 may further include a stator ring assembly 220 that is fixedly coupled (e.g., via bolts, welds or other joining techniques) to the machine frame 210 to remain static therewith during operation while other adjoining components rotate, translate and/or otherwise move relative thereto. The stator ring assembly 220 may include a generally annular structure with a circumferential array of linear guide rails 234.

The butt flare reducing apparatus 200 may further include a flare reducing tool adjustment assembly 230 that is movably coupled to the stator ring assembly 220 to move longitudinally between opposing end positions, as indicated by the double headed arrow 232. More particularly, the flare reducing tool adjustment assembly 230 may be movably coupled to the stator ring assembly 220 to move longitudinally along the circumferential array of linear guide rails 234 between opposing end positions.

The butt flare reducing apparatus 200 may further include one or more actuators 240 that are coupled at one end (e.g., base end) to the stationary machine frame 210 and at the other end 242 (e.g., rod end) to the flare reducing tool adjustment assembly 230 to move the flare reducing tool adjustment assembly 230 longitudinally between opposing end positions. The one or more actuators 240 may be, for example, linear actuators in the form of hydraulic or pneumatic cylinders. In some instances, each of the one or more actuators 240 may be fixedly coupled at one end 241 (e.g., base end) to the stationary machine frame 210 via welds, fasteners or other joining techniques, and may be coupled at the other end 242 (e.g., rod end) to the flare reducing tool adjustment assembly 230, for example, via a pinned or bolted connection.

The butt flare reducing apparatus 200 may further include a rotor assembly 250 that is rotatably coupled to the stator ring assembly 220 via a first rotational bearing 251 (e.g., a roller bearing with opposing races and roller elements therebetween) and rotatably coupled to the flare reducing tool adjustment assembly 230 via a second rotational bearing 253 (e.g., a roller bearing with opposing races and roller elements therebetween) to rotate about the longitudinal axis of rotation $A_2$ during butt flare processing operations. The rotor assembly 250 may include a rotor frame 252 and the aforementioned plurality of flare reducing tools 254 that rotate in unison with the rotor frame 252. As described above, each flare reducing tool 254 may be movably coupled to the rotor frame 252 (e.g., via a sliding carriage arrangement) to translate linearly along a respective tool path $P_3$ toward and away from the longitudinal axis of rotation $A_2$, as indicated by the double headed arrow labeled 256. In some instances, the flare reducing tools 254 move linearly toward and away from the longitudinal axis of rotation $A_2$ in direct correlation to movement of the one or more actuators 240 and the flare reducing tool adjustment assembly 230 coupled thereto. In this manner, a log processing diameter defined by the radial position of the flare reducing tools 254 may be dynamically adjusted with precision before and/or during flare reducing operations by precisely controlling the one or more actuators 240.

With continued reference to FIG. 8, the rotor assembly 250 may include, for each flare reducing tool 254, a respective series of mechanical power transmission components 260 that are coupled to the flare reducing tool 254 to translate longitudinal motion of the flare reducing tool adjustment assembly 230 to radially orientated translational motion of each flare reducing tool 254. The mechanical power transmission components 260 may include, for example, racks and gears. More particularly, the mechanical power transmission components 260 may include an input rack coupled to an output rack by intermediate gears. The input rack may be arranged longitudinally and the output rack may be arranged perpendicularly to the input rack. The mechanical power transmission components 260 may include, for each flare reducing tool 254, two or more intermediate gears positioned between the input rack and the output rack with one of the intermediate gears being in meshing engagement with the input rack and another one of the intermediate gears being in meshing engagement with the output rack.

The rotor assembly 250 may further include at least one force resisting member 258 (e.g., a coil or helical spring, pneumatic bladder, damper, dashpot, hydraulic cylinder with accumulator) coupled between each flare reducing tool 254 and the rotor frame 252 to counterbalance centrifugal forces that may be applied to the flare reducing tools 254 as the rotor assembly 230 rotates during operation. According to the example embodiment of FIG. 8, the force resisting member 258 comprises a hydraulic cylinder that is coupled to one or more accumulators 259 via a manifold 261 and/or hydraulic lines such that fluid may be transferred between the hydraulic cylinder and the accumulator(s) 259 as the radial position of the flare reducing tool 254 is adjusted during operation by the flare reducing tool adjustment assembly 230, and such that hydraulic cylinder and accumulator(s) 259 effectively eliminate unwanted displacement of the flare reducing tool 254 arising from centrifugal forces.

With continued reference to FIG. 8, the butt flare reducing apparatus 200 may further include a control system, including a controller 280 (e.g., a configured computing system including a processor, memory, etc.), that is configured to control at least the rotational functionality of the rotor assembly 250 and movement of the one or more actuators 240 for adjusting the radial position of the flare reducing tools 254. For this purpose, the controller 280 may be communicatively coupled to a drive system 284 that is configured to drive the rotor assembly 250 about the longitudinal axis of rotation $A_2$. Well-known structures and techniques associated with the drive system 284, however, are not shown or described in detail to avoid unnecessarily obscuring descriptions of the embodiments.

The controller 280 may also be communicatively coupled to the one or more actuators 240 to adjust the longitudinal position of the flare reducing tool adjustment assembly 230, which is slidably coupled to the stator ring assembly 220. Displacement of the flare reducing tool adjustment assembly 230 in turn drives the power transmission components 260 and ultimately the flare reducing tools 254. To assist in accurately positioning the flare reducing tools 254, one or more sensors (not shown) may be provided to sense a position of one or more of the actuators 240 (or other movable components coupled thereto) and provide positional feedback to the controller 280 to provide further positional refinement of the one or more actuators 240, if needed. Again, the one or more actuators 240 may be linear actuators, such as hydraulic or pneumatic cylinders. The one or more sensors (not shown) may be high precision non-contact position sensors, such as those sold under the Tempsonics® brand, or other sensors having similar functionality.

The butt flare reducing apparatus 200 may further include a measurement system 282 (e.g., a light curtain) that is communicatively coupled to the controller 280. The measurement system 282 may be configured to successively measure each of a series of logs upstream of the rotor assembly 250 and determine, for each successive log, a desired radial position of the flare reducing tools 254 based on a usable diameter of the log derived from the measurements. The controller 280 may then control the one or more actuators 240 to adjust, for each successive log, an actual radial position of the flare reducing tools 254 simultaneously to correspond to the desired radial position for that log. In this manner, a log processing diameter can be adjusted dynamically for each log before and/or during operation without system shutdown and each log can be processed to remove butt flare with minimal to no wasting of usable log diameter.

In some embodiments, the flare reducing tools 254 may be moved to a fully retracted position (or maximum log diameter) at times between successive logs for safety purposes or to avoid potentially hazardous conditions that may occur upon power loss, for example. Depending on the size of the cut to be made and chipping power requirements related thereto, the controller 280 may communicate with a log feed system 286 to adjust the rate of incoming logs and/or may communicate with the drive system 284 to adjust the rotational speed of the rotor assembly 250.

Although certain specific details are shown and described with reference to the example embodiments shown in FIGS. 1 through 7 and FIG. 8, respectively, one skilled in the relevant art will recognize that other embodiments may be practiced without one or more of these specific details. For example, one or more embodiments of a butt flare reducing apparatus 100, 200 may lack the specific rack and gear power transmission components 160, 260 shown in the example embodiments of FIGS. 1 through 7 and FIG. 8, respectively, and instead may include other power transmission components.

In addition, although each of the example butt flare reducing apparatuses 100, 200 are shown in a configuration in which extension of the actuators 140, 240 pushes the flare reducing tool adjustment assembly 130, 230 to move a series of power transmission components in one direction to retract the flare reducing tools 154, 254 radially away from the longitudinal axis A, $A_2$, and in which retraction of the actuators 140, 240 pulls the flare reducing tool adjustment assembly 130, 230 to move the series of power transmission components in the opposite direction to extend the flare reducing tools 154, 254 radially toward from the longitudinal axis A, $A_2$, it is appreciated that in other embodiments a butt flare reducing apparatus may be configured such that the extension of the actuators 140, 240 extends the flare reducing tools 154, 254 radially toward the longitudinal axis A, $A_2$ while retraction of the actuators 140, 240 retracts the flare reducing tools 154, 254 radially away from the longitudinal axis A, $A_2$.

Moreover, aspects and features of the various embodiments described herein can be combined to provide further embodiments. In addition, U.S. Provisional Patent Application No. 62/030,449, filed Jul. 29, 2014, is incorporated herein by reference for all purposes and aspects of the present invention can be modified, if necessary, to employ features, systems, and concepts disclosed in this application to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

What is claimed is:

1. A butt flare reducing apparatus for logs, the apparatus comprising:

a machine frame;

a stator ring assembly fixedly coupled to the machine frame;

a flare reducing tool adjustment assembly movably coupled to the stator ring assembly to move longitudinally between opposing end positions;

an actuator coupled to the flare reducing tool adjustment assembly to move the flare reducing tool adjustment assembly longitudinally between the opposing end positions; and a rotor assembly rotatably coupled to the stator ring assembly to rotate about a longitudinal axis of rotation, the rotor assembly including a rotor frame, and a flare reducing tool movably coupled to the rotor frame to translate linearly toward and away from the longitudinal axis of rotation in direct correlation to movement of the actuator and flare reducing tool adjustment assembly.

2. The apparatus of claim 1 wherein the flare reducing tool is one of a plurality of flare reducing tools arranged in a circular array, the plurality of flare reducing tools defining a maximum log diameter when the flare reducing tool adjustment assembly is in one of the opposing end positions and defining a minimum log diameter when the flare reducing tool adjustment assembly is in the other one of the opposing end positions.

3. The apparatus of claim 2 wherein the rotor assembly includes, for each flare reducing tool, a respective series of mechanical power transmission components coupled to the flare reducing tool to translate longitudinal motion of the flare reducing tool adjustment assembly to radially orientated translational motion of the flare reducing tool.

4. The apparatus of claim 3 wherein each of the series of mechanical power transmission components includes racks and gears.

5. The apparatus of claim 3 wherein each of the series of mechanical power transmission components includes an input rack coupled to an output rack by at least one intermediate gear.

6. The apparatus of claim 5 wherein the input rack is arranged longitudinally and the output rack is arranged perpendicularly to the input rack.

7. The apparatus of claim 5 wherein at least two intermediate gears are positioned between the input rack and the output rack, one of the intermediate gears being in meshing engagement with the input rack and another one of the intermediate gears being in meshing engagement with the output rack, and wherein a ratio of travel of the output rack relative to travel of the input rack is dependent on characteristics of the intermediate gears.

8. The apparatus of claim 1 wherein the rotor assembly further includes at least one force resisting member coupled between the flare reducing tool and the rotor frame to counterbalance centrifugal force applied to the flare reducing tool as the rotor assembly rotates during operation.

9. The apparatus of claim 1 wherein the flare reducing tool is one of a plurality of flare reducing tools arranged in a circular array, and wherein the apparatus further comprises:

a control system, the control system being configured to successively measure each of a series of logs upstream of the rotor assembly, determine, for each successive log, a desired radial position of the flare reducing tools based on a usable diameter of the log derived from said measurements, and adjust, for each successive log, a respective position of each of the flare reducing tools simultaneously to correspond to the desired radial position.

10. A method of reducing butt flare on each of a series of logs, the method comprising:

successively measuring each of the series of logs upstream of a butt flare reducing apparatus, the apparatus comprising:

a machine frame;

a stator ring assembly fixedly coupled to the machine frame;

a flare reducing tool adjustment assembly movably coupled to the stator ring assembly to move longitudinally between opposing end positions;

at least one actuator coupled to the flare reducing tool adjustment assembly to move the flare reducing tool adjustment assembly longitudinally between the opposing end positions; and a rotor assembly rotatably coupled to the stator ring assembly to rotate about a longitudinal axis of rotation, the rotor assembly including a rotor frame, and an array of flare reducing tools movably coupled to the rotor frame to translate linearly toward and away from the longitudinal axis of rotation in direct correlation to movement of the actuator and flare reducing tool adjustment assembly;

determining, for each successive log, a desired radial position of the flare reducing tools based on a usable diameter of the log derived from said measurements; and adjusting, for each successive log, a position of each flare reducing tool along the respective tool path thereof to correspond to the desired radial position for reducing a butt flare of the log.

11. The method of claim 10 wherein the at least one actuator comprises an array of cylinders, and wherein adjusting the position of each flare reducing tool along the respective tool path thereof includes actuating the array of cylinders to displace all of the flare reducing tools toward or away from the longitudinal axis of rotation simultaneously.

12. The method of claim 11 wherein actuating the array of cylinders to displace the flare reducing tools includes converting longitudinal motion of the cylinders to linear motion of the flare reducing tools perpendicular to the longitudinal axis of rotation.

13. The method of claim 12 wherein converting longitudinal motion of the cylinders to linear motion of the flare reducing tools perpendicular to the longitudinal axis of rotation includes converting longitudinal motion of the cylinders to linear motion of the flare reducing tools via a series of mechanical power transmission components.

14. The method of claim 12 wherein converting longitudinal motion of the cylinders to linear motion of the flare reducing tools perpendicular to the longitudinal axis of rotation includes, for each flare reducing tool, moving a respective input rack longitudinally to rotate at least one respective gear to displace a respective output rack in a direction perpendicular to the input rack.

15. The method of claim 12 wherein converting longitudinal motion of the cylinders to linear motion of the flare reducing tools perpendicular to the longitudinal axis of rotation includes longitudinally displacing the flare reducing tool adjustment assembly.

16. The method of claim 11, further comprising:

obtaining positional data from at least one cylinder of the array of cylinders; and using said positional data to precisely control the position of the flare reducing tools.

17. The method of claim 10, further comprising: obtaining positional data from the flare reducing tool adjustment assembly; and using said positional data to precisely control the position of the flare reducing tools.

* * * * *